US010733935B2

(12) United States Patent
Cha et al.

(10) Patent No.: US 10,733,935 B2
(45) Date of Patent: Aug. 4, 2020

(54) DISPLAY DEVICE

(71) Applicant: SAMSUNG DISPLAY CO., LTD., Yongin-si, Gyeonggi-do (KR)

(72) Inventors: Seung Ji Cha, Yongin-si (KR); Seung Kyu Lee, Yongin-si (KR); Kyung Hoon Kim, Yongin-si (KR); Mi Hae Kim, Yongin-si (KR); Jae Du Noh, Yongin-si (KR); Jae Sic Lee, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/412,927

(22) Filed: May 15, 2019

(65) Prior Publication Data

US 2020/0043406 A1 Feb. 6, 2020

(30) Foreign Application Priority Data

Jul. 31, 2018 (KR) ..... 10-2018-0089322

(51) Int. Cl.
*G09G 3/325* (2016.01)
*G09G 3/3283* (2016.01)

(52) U.S. Cl.
CPC ..... *G09G 3/325* (2013.01); *G09G 3/3283* (2013.01); *G09G 2300/0439* (2013.01); *G09G 2300/0861* (2013.01); *G09G 2310/0264* (2013.01)

(58) Field of Classification Search
CPC ..... G02F 1/136286; G02F 1/136209; G02F 1/133512; G02F 2001/136218; G02F 2001/13606; G02F 2001/134318; G09G 3/3648; G09G 3/3614; G09G 3/3688; G09G 3/3233; G09G 2300/0426; G09G 2300/0465; G09G 2300/0439;
(Continued)

(56) References Cited

U.S. PATENT DOCUMENTS

2007/0040770 A1* 2/2007 Kim ..... G09G 3/3233 345/76
2011/0084955 A1 4/2011 Kim
(Continued)

FOREIGN PATENT DOCUMENTS

KR 101101070 B1 12/2011
KR 1020160043177 A 4/2016
KR 1020170031323 A 3/2017

*Primary Examiner* — Dong Hui Liang
(74) *Attorney, Agent, or Firm* — Cantor Colburn LLP

(57) ABSTRACT

A display device may include: a first pixel including first and second sub-pixels coupled to first and second data lines; a data driver which supplies data signals to first and second output lines; and a switch unit which distributes the data signals to the first and the second data lines. The first and the second sub-pixels are line-symmetrical with each other. Each of the first and the second sub-pixels may include: an OLED; a first transistor which controls a driving current flowing from a first power supply to a second power supply via the OLED, in response to a voltage supplied to a node connected thereto; emission control transistors which are turned on when an emission control signal is supplied; and a reference transistor which couples a shielding layer overlapping a corresponding data line to the first power supply when the emission control signal is supplied thereto.

19 Claims, 9 Drawing Sheets

(58) Field of Classification Search
CPC ... G09G 2300/0443; G09G 2320/0233; G09G 2320/0209
See application file for complete search history.

(56) References Cited

U.S. PATENT DOCUMENTS

| | | | | |
|---|---|---|---|---|
| 2015/0002379 | A1* | 1/2015 | Kim | G09G 3/3233 345/82 |
| 2016/0210905 | A1* | 7/2016 | Lee | H01L 27/1222 |
| 2017/0076665 | A1 | 3/2017 | Kim | |
| 2017/0330928 | A1* | 11/2017 | Choi | H01L 27/124 |
| 2018/0012542 | A1* | 1/2018 | Lee | G09G 3/3233 |
| 2018/0175135 | A1* | 6/2018 | Lim | H01L 27/3272 |

* cited by examiner

DISPLAY DEVICE

This application claims priority to Korean Patent Application No. 10-2018-0089322, filed on Jul. 31, 2018, and all the benefits accruing therefrom under 35 U.S.C. § 119, the content of which in its entirety is herein incorporated by reference.

BACKGROUND

1. Field

Various embodiments of the disclosure relate to a display device, and more particularly, to an organic light-emitting display device.

2. Description of Related Art

With the development of information technology, the desirability of a display device that is a connection medium between a user and information has been emphasized. Owing to the desirability of the display device, the use of various display devices, such as a liquid crystal display ("LCD") device and an organic light-emitting display device, has increased.

An organic light-emitting display device typically displays an image using organic light-emitting diodes which generate light by recombination of electrons and holes. The organic light-emitting display device may have a high response speed and may display a clear image.

Such an organic light-emitting display device may include pixels, a data driver configured to supply data signals to the pixels, a scan driver configured to supply scan signals to the pixels, and an emission control driver configured to supply emission control signals to the pixels.

SUMMARY

Embodiments of the disclosure are directed to a display device in which coupling between data lines is effectively prevented by simultaneously charging a voltage of a data signal to the data lines coupled to sub-pixels included in a pixel having a flip structure.

According to an embodiment of the disclosure, a display device includes: a first pixel comprising a first sub-pixel coupled to a first data line, and a second sub-pixel coupled to a second data line; a data driver which supplies data signals to a first output line and a second output line in a time-sharing manner; and a switch unit which distributes the data signals to the first data line and the second data line based on a first control signal. In such an embodiment, a structure of the first sub-pixel and a structure of the second sub-pixel are line-symmetrical with each other, based on the first data line and the second data line, which are disposed between the first sub-pixel and the second sub-pixel. In such an embodiment, each of the first sub-pixel and the second sub-pixel includes: an organic light-emitting diode; a first transistor which control driving current flowing from a first power supply to a second power supply via the organic light-emitting diode, in response to a voltage supplied to a node connected thereto; emission control transistors disposed on a path of the driving current and which are turned on when an emission control signal is supplied thereto; and a reference transistor which couples a shielding layer overlapping a corresponding data line to the first power supply when the emission control signal is supplied thereto.

In an embodiment, the first sub-pixel and the second sub-pixel may emit light of different colors from each other.

In an embodiment, the first sub-pixel may emit at least one of red light and blue light, and the second sub-pixel may emit green light.

In an embodiment, the display device may further include a second pixel comprising a third sub-pixel coupled to a third data line, and a fourth sub-pixel coupled to a fourth data line. In such an embodiment, the switch unit may distribute the data signals to the third data line and the fourth data line based on a second control signal.

In an embodiment, the switch unit may include: a first switch which couples the first output line to the first data line when the first control signal is supplied thereto; a second switch which couples the second output line to the second data line when the second control signal is supplied thereto; a third switch which couples the first output line to the third data line when the first control signal is supplied thereto; and a fourth switch which couples the second output line to the fourth data line when the second control signal is supplied thereto.

In an embodiment, at least one of the first switch, the second switch, the third switch, and the fourth switch may be a P-type metal-oxide-semiconductor ("PMOS") transistor.

In an embodiment, a period, during which the first control signal is supplied, may not overlap a period, during which the second control signal is supplied.

In an embodiment, the display device may further include a scan driver which supplies a scan signal to a scan line coupled to the first pixel and the second pixel.

In an embodiment, a period, during which the first control signal is supplied, and a period, during which the second control signal is supplied, may not overlap a period, during which the scan signal is supplied.

In an embodiment, the data driver may supply a first data signal and a second data signal to the first output line and the second output line when the first control signal is supplied thereto. In such an embodiment, the data driver may supply a third data signal and a fourth data signal to the first output line and the second output line when the second control signal is supplied thereto.

In an embodiment, the first to fourth data signals may be applied to the first to the fourth sub-pixels, respectively, in response to the scan signal supplied thereto.

In an embodiment, the display device may further include a timing controller which supplies the first control signal and the second control signal to the switch unit.

According to another embodiment of the disclosure, a display device includes: a first pixel including first and second sub-pixels coupled to first and second data lines, respectively; a scan driver which supplies a scan signal to a scan line coupled to the first and the second sub-pixels; an emission control driver which supplies an emission control signal to an emission control line coupled to the first and the second sub-pixels; a data driver which supplies data signals to a first output line and a second output line in a time-sharing manner; and a switch unit which distributes the data signals to the first and the second data lines based on a first control signal. In such an embodiment, each of the first and the second sub-pixels includes: a first transistor which controls a driving current flowing from a first power supply to a second power supply in response to a voltage supplied to a node connected thereto; a shielding layer overlapping the first and the second data lines; and a reference transistor which couples the shielding layer to the first power supply when the emission control signal is supplied thereto.

In an embodiment, a structure of the first sub-pixel and a structure of the second sub-pixel may be line-symmetrical with each other based on the first data line and the second data line, which are disposed between the first sub-pixel and the second sub-pixel.

In an embodiment, the first sub-pixel and the second sub-pixel may emit light of different colors from each other.

In an embodiment, the first sub-pixel may emit at least one of red light and blue light, and the second sub-pixel may emit green light.

In an embodiment, the display device may further include a second pixel comprising third and fourth sub-pixels coupled to third and fourth data lines, respectively. In such an embodiment, the switch unit may distribute the data signals to the third data line and the fourth data line based on a second control signal.

In an embodiment, the switch unit may include: a first switch which couples the first output line to the first data line when the first control signal is supplied thereto; a second switch which couples the second output line to the second data line when the second control signal is supplied thereto; a third switch which couples the first output line to the third data line when the first control signal is supplied thereto; and a fourth switch which couples the second output line to the fourth data line when the second control signal is supplied thereto.

In an embodiment, a period, during which the first control signal is supplied, may not overlap a period, during which the second control signal is supplied.

In embodiments of a display device in accordance with the disclosure, a voltage of a data signal may be simultaneously charged to data lines coupled to sub-pixels included in a pixel having a flip structure, such that coupling between the data lines may be effectively prevented.

In such embodiments of a display device in accordance with the disclosure, the image quality may be improved by reducing color deviation.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
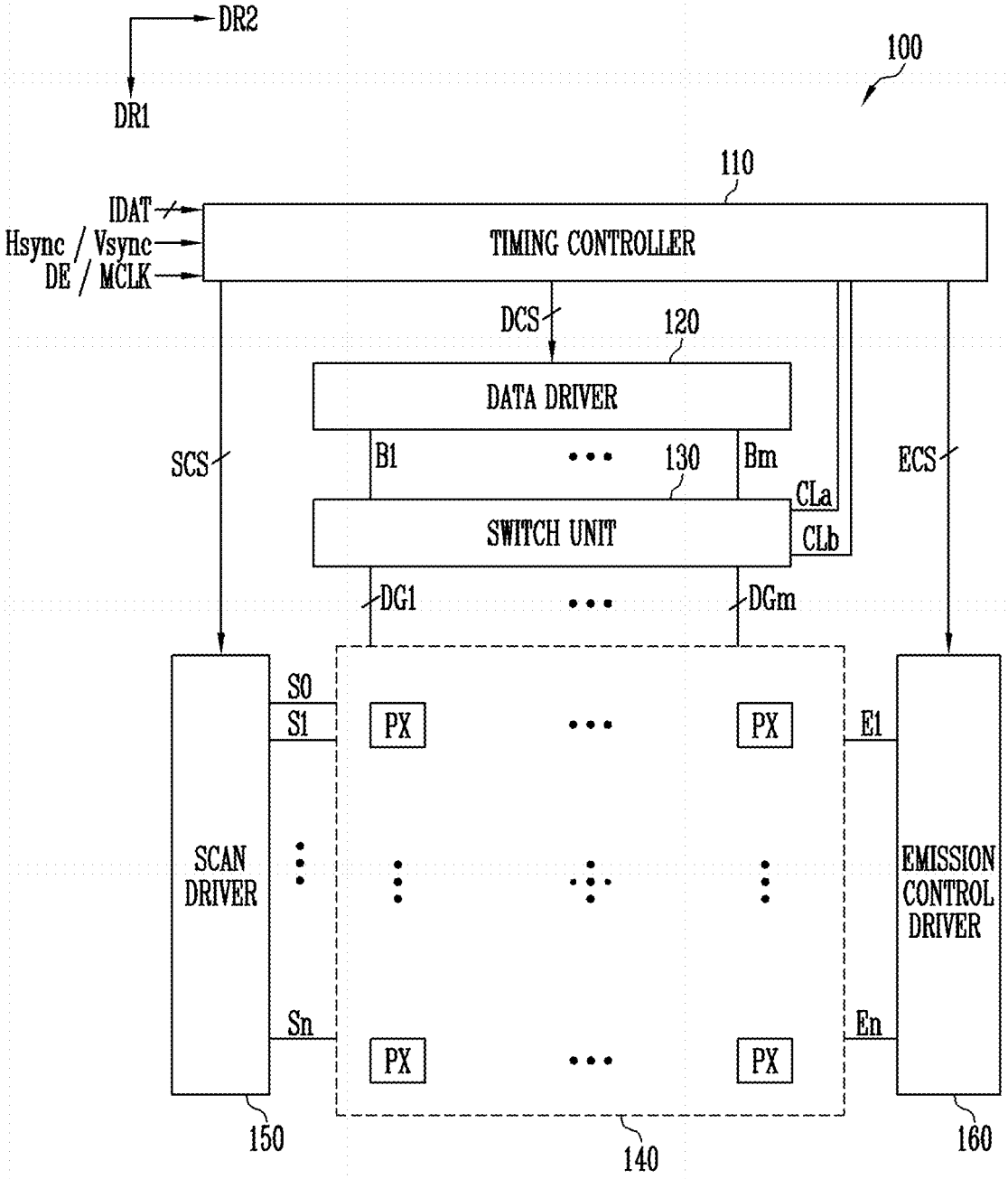
FIG. 1 is a diagram illustrating a display device in accordance with an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." "At least one of A and B" means "A and/or B." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

It will be understood that when an element is referred to as being "on" another element, it can be directly on the other element or intervening elements may be present therebetween. In contrast, when an element is referred to as being "directly on" another element, there are no intervening elements present. It is also noted that in this specification, "connected/coupled" refers to one component not only directly coupling another component but also indirectly coupling another component through an intermediate component. On the other hand, "directly connected/directly coupled" refers to one component directly coupling another component without an intermediate component.

Hereinafter, embodiments of the invention will be described in detail with reference to the accompanying drawings.

FIG. 1 is a diagram illustrating a display device 100 in accordance with an embodiment of the disclosure.

Referring to FIG. 1, an embodiment of the display device 100 may include a timing controller 110, a data driver 120, a switch unit 130, a pixel unit 140, a scan driver 150, and an emission control driver 160.

The timing controller 110 may control an overall operation of the display device 100.

The timing controller 110 may receive external image data IDAT and external control signals from an external device. In one embodiment, for example, the external control signals may include a vertical synchronization signal Vsync, a horizontal synchronization signal Hsync, a main clock signal MCLK, and a data enable signal DE.

The timing controller 110 may process the external image data IDAT to generate image data suitable for operating conditions of the data driver 120.

The timing controller 110 may transmit a data control signal DCS to the data driver 120. In one embodiment, for example, the data control signal DCS may include image data, a frame control signal, and a clock signal.

The timing controller 110 may transmit a first control signal and a second control signal to the switch unit 130 through a first control line CLa and a second control line CLb. In one embodiment, for example, each of the first and the second control signals may have a gate-on voltage.

The timing controller 110 may transmit a scan control signal SCS to the scan driver 150. In one embodiment, for example, the scan control signal SCS may include a scan start signal and at least one scan clock signal. The scan start signal may control supply timings of scan signals, and the scan clock signal may be used to shift the scan start signal.

The timing controller 110 may transmit an emission control signal ECS to the emission control driver 160. In one embodiment, for example, the emission control signal ECS may include an emission start signal and clock signals. The emission start signal may control a supply timing of an emission control signal, and the clock signals may be used to shift the emission start signal.

The data driver 120 may receive a data control signal DCS from the timing controller 110.

The data driver 120 may supply data signals to output lines B1 to Bm (m is a natural number), based on the data control signal DCS.

In an embodiment, the data driver 120 may supply the data signals to the output lines B1 to Bm in a time-sharing manner.

In one embodiment, for example, the data driver 120 may supply the data signals to the output lines B1 to Bm in synchronization with a corresponding scan signal.

In an embodiment, the data driver 120 may be define by a data driving integrated circuit ("IC").

The switch unit 130 may receive data signals from the output lines B1 to Bm. The switch unit 130 may distribute the data signals to data line groups DG1 to DGm. In an embodiment, the switch unit 130 may mean a demultiplexer.

The pixel unit 140 may include a substrate, and pixels PX disposed on the substrate.

In an embodiment, the pixel unit 140 may define a display region of a display panel of the display device 100.

The pixels PX may be coupled (e.g., electrically connected) to corresponding scan lines S0 to Sn (n is a natural number), corresponding emission control lines E1 to En, and the corresponding data line groups DG1 to DGm.

In one embodiment, for example, the pixels PX may be disposed on intersections of the scan lines S0 to Sn, the emission control lines E1 to En and the data line groups DG1 to DGm.

The pixels PX may be supplied with scan signals through the scan lines S0 to Sn.

The pixels PX may be supplied with emission control signals through the emission control lines E1 to En.

The pixels PX may be supplied with data signals through the data line groups DG1 to DGm.

Each pixel PX may emit light at a grayscale corresponding to a data signal applied thereto.

In an embodiment, the data lines may extend in a first direction DR1 (e.g., in a vertical direction). The scan lines S0 to Sn and the emission control lines E1 to En may extend in a second direction DR2 (e.g., in a horizontal direction) different from the first direction.

In an embodiment, each of the pixels PX may be coupled to a corresponding one of the scan lines S0 to Sn and coupled to a corresponding one of the data line groups DG1 to DGm.

The scan driver 150 may receive a scan control signal SCS from the timing controller 110.

The scan driver 150 may supply scan signals to the scan lines S0 to Sn, based on the scan control signal SCS.

In one embodiment, for example, the scan driver 150 may sequentially supply the scan signals to the scan lines S0 to Sn. In an embodiment, each scan signal may have a gate-on voltage.

The emission control driver 160 may receive an emission control signal ECS from the timing controller 110.

The emission control driver 160 may supply emission control signals to the emission control lines E1 to En, based on the emission control signal ECS.

In one embodiment, for example, the emission control driver 160 may sequentially supply the emission control signals to the emission control lines E1 to En. In an embodiment, each emission control signal may have a gate-on voltage.

FIG. 1 shows an embodiment where n+1 scan lines S0 to Sn and n emission control lines E1 to En are provided, but the disclosure is not limited thereto. In one alternative embodiment, for example, dummy scan lines and/or dummy emission control lines may be additionally provided to secure the reliability of the operation.

FIG. 1 shows an embodiment where the timing controller 110, the data driver 120, the switch unit 130, the scan driver 150, and the emission control driver 160 are separately provided, but not being limited thereto. In an alternative embodiment, at least some of the foregoing components may be integrated with each other.

The timing controller 110, the data driver 120, the switch unit 130, the scan driver 150 and the emission control driver 160 may be in any one of various forms, e.g., a chip-on-glass form, a chip-on-plastic form, a tape carrier package form, and a chip-on-film form.

Figure 2:
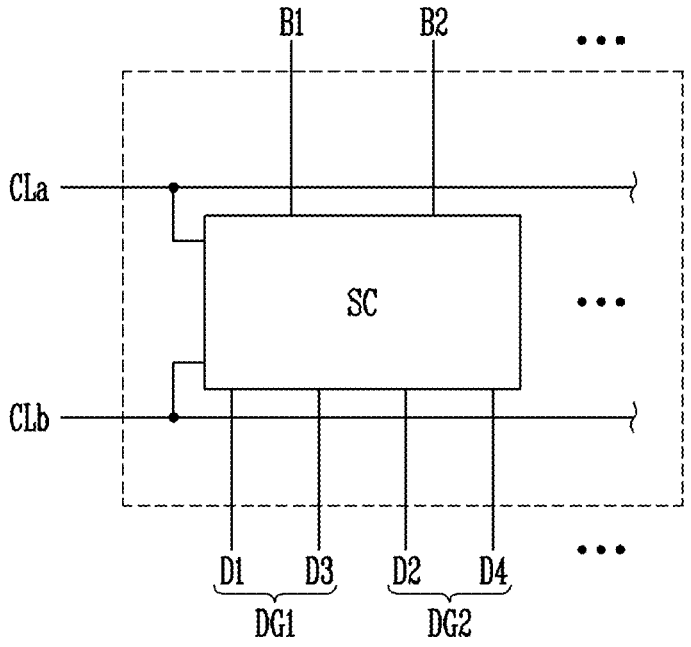
FIG. 2 is a diagram illustrating a switch unit in accordance with an embodiment of the disclosure.

FIG. 2 is a diagram illustrating the switch unit 130 in accordance with an embodiment of the disclosure.

Referring to FIG. 2, an embodiment of the switch unit 130 may include a plurality of switch circuits SC.

For convenience of illustration and description, FIG. 2 shows a first switch circuit SC of the switch circuits SC. Hereinafter, the first switch circuit SC (hereinafter, the switch circuit SC) will be described in detail with reference to FIG. 2. The other switch circuits SC of the switch circuits SC are substantially the same as the first switch circuit SC, and any repetitive detailed description thereof will be omitted.

The switch circuit SC may be coupled to the first output line B1 and a second output line B2.

In such an embodiment, a k-th (k is a natural number) switch circuit SC may be coupled to a (2k−1)-th output line and a 2k-th output line.

The switch circuit SC may receive data signals through the first output line B1 and the second output line B2.

The switch circuit SC may be coupled to a first control line CLa and a second control line CLb. The switch circuit SC may receive a first control signal and a second control signal through the first control line CLa and the second control line CLb.

The switch circuit SC may be coupled to a first data line group DG1 and a second data line group DG2. In such an embodiment, a k-th switch circuit SC may be coupled to a (2k−1)-th data line group and a 2k-th data line group.

The switch circuit SC may supply data signals to the first data line group DG1 and the second data line group DG2.

In an embodiment, the first data line group DG1 may include a first data line D1 and a third data line D3, and the second data line group DG2 may include a second data line D2 and a fourth data line D4.

In such an embodiment, the (2k−1)-th data line group may include a (4k−3)-th data line and a (4k−1)-th data line, and the 2k-th data line group may include a (4k−2)-th data line and a 4k-th data line.

Therefore, the switch circuit SC may be coupled to the first data line D1, the second data line D2, the third data line D3 and the fourth data line D4.

In such an embodiment, the k-th switch circuit SC may be coupled to the (4k−3)-th data line, the (4k−2)-th data line, the (4k−1)-th data line and the 4k-th data line.

In an embodiment, the switch circuit SC may distribute data signals supplied from the first output line B1, to the first data line D1 and the second data line D2, based on the first control signal.

In an embodiment, the switch circuit SC may distribute data signals supplied from the second output line B2, to the third data line D3 and the fourth data line D4, based on the second control signal.

In such an embodiment, the k-th switch circuit SC may distribute data signals received through the (2k−1)-th output line, to the (4k−3)-th data line and the (4k−2)-th data line, based on the first control signal.

In such an embodiment, the k-th switch circuit SC may distribute data signals received through the 2k-th output line, to the (4k−1)-th data line and the 4k-th data line, based on the second control signal.

Figure 3:
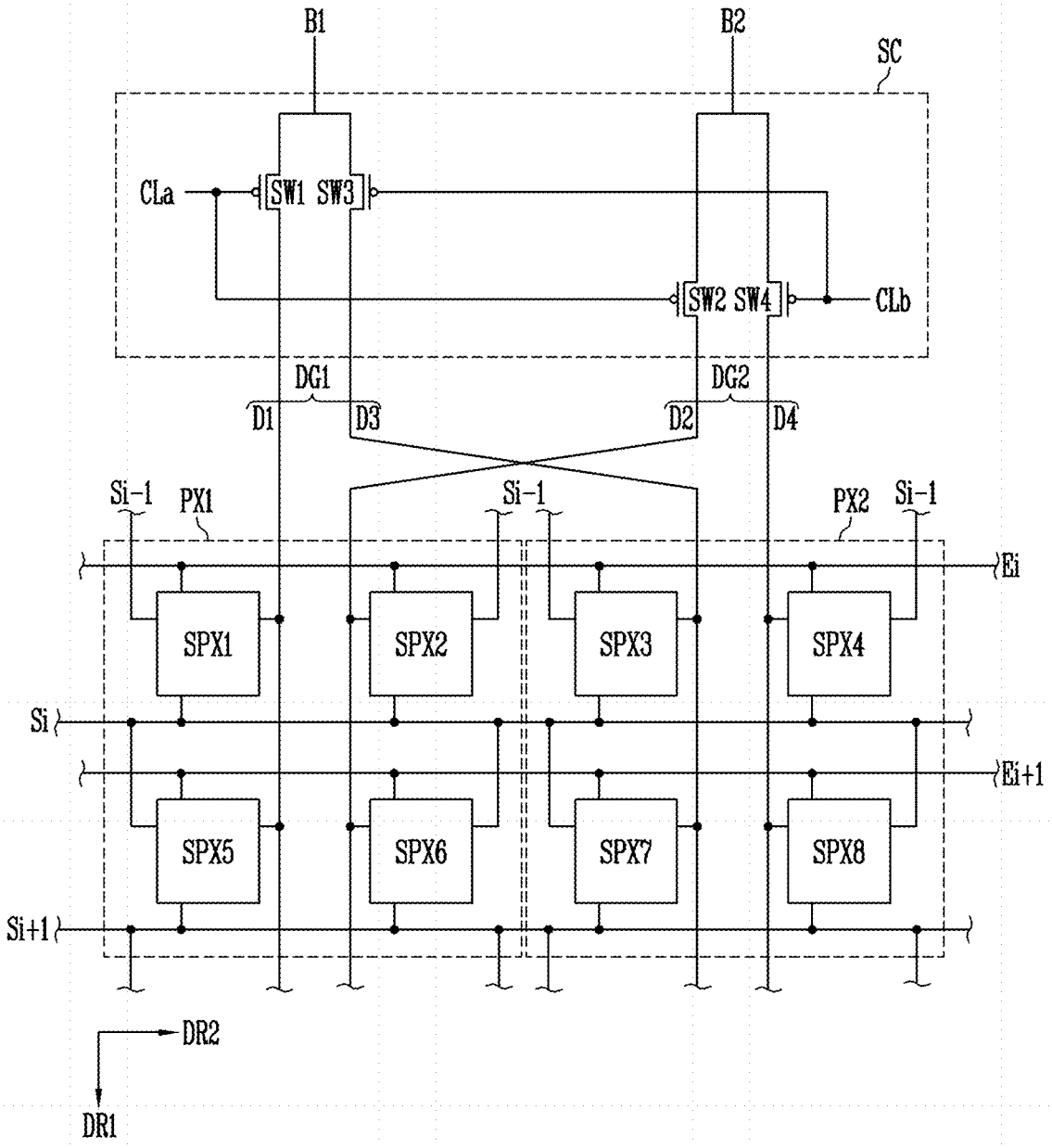
FIG. 3 is a diagram illustrating pixels and a switch circuit in accordance with an embodiment of the disclosure.

FIG. 3 is a diagram illustrating pixels PX1 and PX2 and the switch circuit SC in accordance with an embodiment of the disclosure.

Referring to FIGS. 2 and 3, the switch circuit SC may include a first switch SW1, a second switch SW2, a third switch SW3 and a fourth switch SW4.

The first switch SW1 may be coupled between the first output line B1 and the first data line D1.

When a first control signal is supplied to the first switch SW1 through the first control line CLa, the first switch SW1 is turned on to connect the first output line B1 to the first data line D1.

The second switch SW2 may be coupled between the second output line B2 and the second data line D2.

When the first control signal is supplied to the second switch SW2 through the first control line CLa, the second switch SW2 is turned on to connect the second output line B2 to the second data line D2.

The third switch SW3 may be coupled between the first output line B1 and the third data line D3.

When a second control signal is supplied to the third switch SW3 through the second control line CLb, the third switch SW3 is turned on to couple the first output line B1 to the third data line D3.

The fourth switch SW4 may be coupled between the second output line B2 and the fourth data line D4.

When the second control signal is supplied to the fourth switch SW4 through the second control line CLb, the fourth switch SW4 is turned on to connect the second output line B2 to the fourth data line D4.

In an embodiment, at least one of the first switch SW1, the second switch SW2, the third switch SW3 and the fourth switch SW4 may include a P-type metal-oxide-semiconductor ("PMOS") transistor.

For convenience of description, a first pixel PX1 and a second pixel PX2 corresponding to the first switch circuit SC will be representatively described with reference to FIG. 3. Therefore, the other switch pixels PX (not shown) are substantially the same as the first pixel PX1 and the second pixel PX2, and any repetitive detailed description thereof will be omitted.

In an embodiment, the first pixel PX1 and the second pixel PX2 may be coupled to the first data line group DG1 and the second data line group DG2.

The first pixel PX1 may be coupled to the first data line D1 and the second data line D2. The second pixel PX2 may be coupled to the third data line D3 and the fourth data line D4.

The first pixel PX1 and the second pixel PX2 may be coupled to an i-th scan line Si (i is a natural number).

The first pixel PX1 and the second pixel PX2 may include first to eighth sub-pixels SPX1 to SPX8. In one embodiment, for example, the first pixel PX1 may include the first sub-pixel SPX1, the second sub-pixel SPX2, the fifth sub-pixel SPX5 and the sixth sub-pixel SPX6. In such an embodiment, the second pixel PX2 may include the third sub-pixel SPX3, the fourth sub-pixel SPX4, the seventh sub-pixel SPX7 and the eighth sub-pixel SPX8.

In the first pixel PX1, the first sub-pixel SPX1 may emit light of a first color, the fifth sub-pixel SPX5 may emit light of a second color, and each of the second sub-pixel SPX2 and the sixth sub-pixel SPX6 may emit light of a third color.

In the second pixel PX2, the third sub-pixel SPX3 may emit light of the first color, the seventh sub-pixel SPX7 may emit light of the second color, and each of the fourth sub-pixel SPX4 and the eighth sub-pixel SPX8 may emit light of the third color.

In an embodiment, the first color and the second color may be respectively one of red and blue, and the other one of red and blue, and the third color may be green.

The first to the eighth sub-pixels SPX1 to SPX8 may have substantially the same circuit configuration as each other, which will be described later in greater detail with reference to FIG. 5.

Each of the first pixel PX1 and the second pixel PX2 may have a flip pixel structure. Herein, the term "flip pixel structure" refers to a structure in which sub-pixels form a line-symmetric structure based on data lines disposed between the sub-pixels. Such a structure will be described later in greater detail with reference to FIG. 7.

The first to the fourth sub-pixels SPX1 to SPX4 may be coupled to an (i−1)-th scan line Si−1, the i-th scan line Si and an i-th emission control line Ei. The fifth to eighth sub-pixels SPX5 to SPX8 may be coupled to the i-th scan line Si, an (i+1)-th scan line Si+1, and an (i+1)-th emission control line Ei+1.

For convenience of description, hereinbelow, details of the first to the fourth sub-pixels SPX1 to SPX4 will be representatively described. In such an embodiment, the fifth to eighth sub-pixels SPX5 to SPX8 are substantially the same as the first to the fourth sub-pixels SPX1 to SPX4, and any repetitive detailed description thereof will be omitted.

The first sub-pixel SPX1 may be coupled to the first data line D1. The second sub-pixel SPX2 may be coupled to the second data line D2. The third sub-pixel SPX3 may be coupled to the third data line D3. The fourth sub-pixel SPX4 may be coupled to the fourth data line D4.

Figure 4:
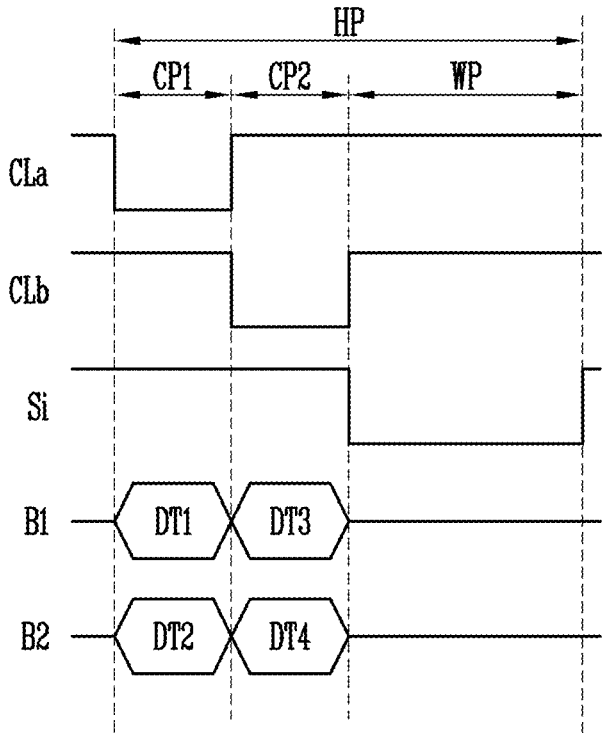
FIG. 4 is a diagram illustrating a method of driving the display device in accordance with an embodiment of the disclosure.

FIG. 4 is a diagram illustrating a method of driving the display device in accordance with an embodiment of the disclosure.

Referring to FIGS. 1 to 4, sub-pixels disposed on a horizontal line may be driven with a horizontal period HP as a unit.

FIG. 4 shows a scan signal to be supplied to the i-th scan line Si, a first control signal to be supplied to the first control line CLa, and a second control signal to be supplied to the second control line CLb.

The horizontal period HP may include a first charging period CP1, a second charging period CP2, and a write period WP.

In an embodiment, during the first charging period CP1, the timing controller 110 may supply the first control signal to the switch unit 130 through the first control line CLa. When the first control signal is supplied, the first switch SW1 and the second switch SW2 may be turned on, such that the first output line B1 and the first data line D1 may be coupled to each other, and the second output line B2 and the second data line D2 may be coupled to each other.

In such an embodiment, during the first charging period CP1, the data driver 120 may supply a first data signal DT1 to the first output line B1 and supply a second data signal DT2 to the second output line B2. Therefore, the first data line D1 may be charged with a voltage of the first data signal DT1, and the second data line D2 may be charged with a voltage of the second data signal DT2.

In an embodiment, during the second charging period CP2, the timing controller 110 may supply the second control signal to the switch unit 130 through the second control line CLb. When the second control signal is supplied, the third switch SW3 and the fourth switch SW4 may be turned on, such that the first output line B1 and the third data line D3 may be coupled to each other, and the second output line B2 and the fourth data line D4 may be coupled to each other.

In such an embodiment, during the second charging period CP2, the data driver 120 may supply a third data signal DT3 to the first output line B1 and supply a fourth data signal DT4 to the second output line B2. Therefore, the third data line D3 may be charged with a voltage of the third data signal DT3, and the fourth data line D4 may be charged with a voltage of the fourth data signal DT4.

During the write period WP, the scan driver 150 may supply the scan signal to the i-th scan line Si. When the scan signal is supplied, voltages of the data signals applied to the first data line D1, the second data line D2, the third data line D3 and the fourth data line D4 may be applied to the first sub-pixel SPX1, the second sub-pixel SPX2, the third sub-pixel SPX3 and the fourth sub-pixel SPX4, respectively.

In an embodiment, the first to the fourth data signals DT1 to DT4 may be written to the first to fourth sub-pixels SPX1 to SPX4 as described above.

Figure 5:
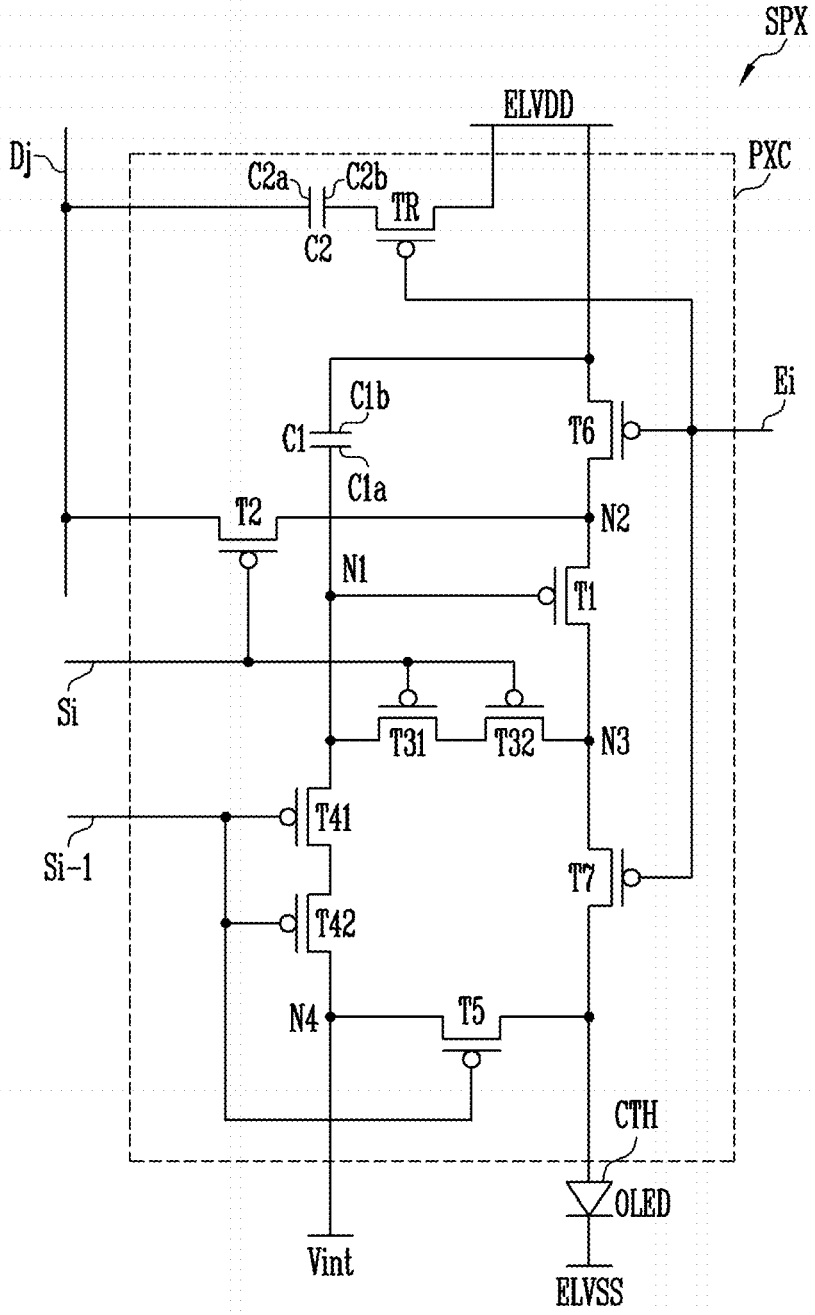
FIG. 5 is a diagram illustrating a sub-pixel in accordance with an embodiment of the disclosure.

FIG. 5 is a diagram illustrating a sub-pixel SPX in accordance with an embodiment of the disclosure.

FIG. 5 illustrates a circuit diagram of a sub-pixel SPX in accordance with an embodiment of the disclosure. In an embodiment, each of the first to the eighth sub-pixels SPX1 to SPX8 shown in FIG. 3 may have the pixel structure shown in FIG. 5.

For convenience of illustration and description, FIG. 5 illustrates a sub-pixel SPX coupled with an i-th (i is a natural number) emission control line Ei and a j-th (j is a natural number) data line Dj.

Referring to FIG. 5, the sub-pixel SPX may include a pixel circuit PXC and an organic light-emitting diode OLED.

An anode electrode CTH of the organic light-emitting diode OLED may be coupled to the pixel circuit PXC, and a cathode electrode thereof may be coupled to a second power supply ELVSS.

The organic light-emitting diode OLED may emit light having a predetermined luminance corresponding to driving current supplied from the pixel circuit PXC.

A first power supply ELVDD may have a voltage higher than that of the second power supply ELVSS to allow current to flow to the organic light-emitting diode OLED.

In an embodiment, the pixel circuit PXC may control, in response to a data signal, driving current flowing from the first power supply ELVDD to the second power supply ELVSS via the organic light-emitting diode OLED. In such an embodiment, the pixel circuit PXC may include a first transistor T1, a second transistor T2, a third transistor T31 and T32, a fourth transistor T41 and T42, a fifth transistor T5, emission control transistors including a sixth transistor T6 and a seventh transistor T7, a reference transistor 1R, a first capacitor C1, and a second capacitor C2.

In an embodiment, a first node N1 may be a common node which is coupled to a gate electrode of the first transistor T1, the first capacitor C1, the third transistor T31 and T32, and the fourth transistor T41 and T42.

In such an embodiment, a second node N2 may be a common node which is coupled to the first transistor T1, the second transistor T2, and the sixth transistor T6.

In such an embodiment, a third node N3 may be a common node which is coupled to the first transistor T1, the third transistor T31 and T32, and the seventh transistor T7.

In such an embodiment, a fourth node N4 may be a common node which is coupled to the fourth transistor T41 and T42, the fifth transistor T5, and a third power supply Vint.

In an embodiment, a first electrode of the first transistor (driving transistor) T1 may be coupled to the second node N2, and a second electrode thereof may be coupled to the third node N3. The gate electrode of the first transistor T1 may be coupled to the first node N1.

The first transistor T1 may control, in response to a voltage supplied to the first node N1, driving current flowing from the first power supply ELVDD to the second power supply ELVSS via the organic light-emitting diode OLED.

The second transistor T2 may be coupled between the j-th data line Dj and the second node N2. A gate electrode of the second transistor T2 may be coupled to the i-th scan line Si.

When a scan signal is supplied to the i-th scan line Si, the second transistor T2 may be turned on to couple the j-th data line Dj with the second node N2.

The third transistor T31 and T32 may be coupled between the first node N1 and the third node N3. A gate electrode of the third transistor T31 and T32 may be coupled to the i-th scan line Si.

When a scan signal is supplied to the i-th scan line Si, the third transistor T31 and T32 may be turned on such that the first transistor T1 is connected in the form of a diode or diode-connected.

In an embodiment, the third transistor T31 and T32 may be defined by multi-transistors.

The fourth transistor T41 and T42 may be coupled between the first node N1 and the fourth node N4. A gate electrode of the fourth transistor T41 and T42 may be coupled to the (i−1)-th scan line Si−1.

When a scan signal is supplied to the (i−1)-th scan line Si−1, the fourth transistor T41 and T42 is turned on such that the voltage of the third power supply Vint is supplied to the first node N1.

In an embodiment, the fourth transistor T41 and T42 may be defined by multi-transistors.

The fifth transistor T5 may be coupled between the anode electrode CTH and the fourth node N4. A gate electrode of the fifth transistor T5 may be coupled to the (i−1)-th scan line Si−1.

When a scan signal is supplied to the (i−1)-th scan line Si−1, the fifth transistor T5 is turned on such that the voltage of the third power supply Vint is supplied to the anode electrode CTH.

In an embodiment, a gate electrode of the fifth transistor T5 may be coupled to the (i+1)-th scan line Si+1 or the i-th scan line Si.

The voltage of the third power supply Vint may be lower than that of a data signal.

The emission control transistors may be disposed on a path along which driving current flows, and may apply driving current in response to an emission control signal supplied to an i-th emission control line Ei.

In one embodiment, for example, the emission control transistors may include the sixth transistor (a first emission control transistor) T6 and the seventh transistor (a second emission control transistor) T7.

The sixth transistor T6 may be coupled between the first power supply ELVDD and the second node N2. A gate electrode of the sixth transistor T6 may be coupled to the i-th emission control line Ei.

The sixth transistor T6 may be turned on when an emission control signal is supplied to the i-th emission control line Ei.

The seventh transistor T7 may be coupled between the third node N3 and the anode electrode CTH. A gate electrode of the seventh transistor T7 may be coupled to the i-th emission control line Ei. The seventh transistor T7 may be turned on when an emission control signal is supplied to the i-th emission control line Ei.

The reference transistor TR may be coupled between the second capacitor C2 and the first power supply ELVDD. A gate electrode of the reference transistor TR may be coupled to the i-th emission control line Ei.

The reference transistor TR may be turned on when an emission control signal is supplied to the i-th emission control line Ei, such that the voltage of the first power supply ELVDD may be supplied to a second electrode C2*b* of the second capacitor C2.

The first capacitor C1 may be coupled between the first power supply ELVDD and the first node N1.

The first capacitor C1 may include first and second electrodes C1*a* and C1*b*. The first electrode C1*a* of the first capacitor C1 may be coupled to the first node N1, and the second electrode C1*b* thereof may be coupled to the first power supply ELVDD.

The first capacitor C1 may store a voltage corresponding to a data signal and a threshold voltage of the first transistor T1.

The second capacitor C2 may be coupled between the j-th data line Dj and the reference transistor TR.

The second capacitor C2 may include first and second electrodes C2*a* and C2*b*. The first electrode C2*a* of the second capacitor C2 may be coupled to the j-th data line Dj, and the second electrode C2*b* thereof may be coupled to the reference transistor TR.

Figure 7:
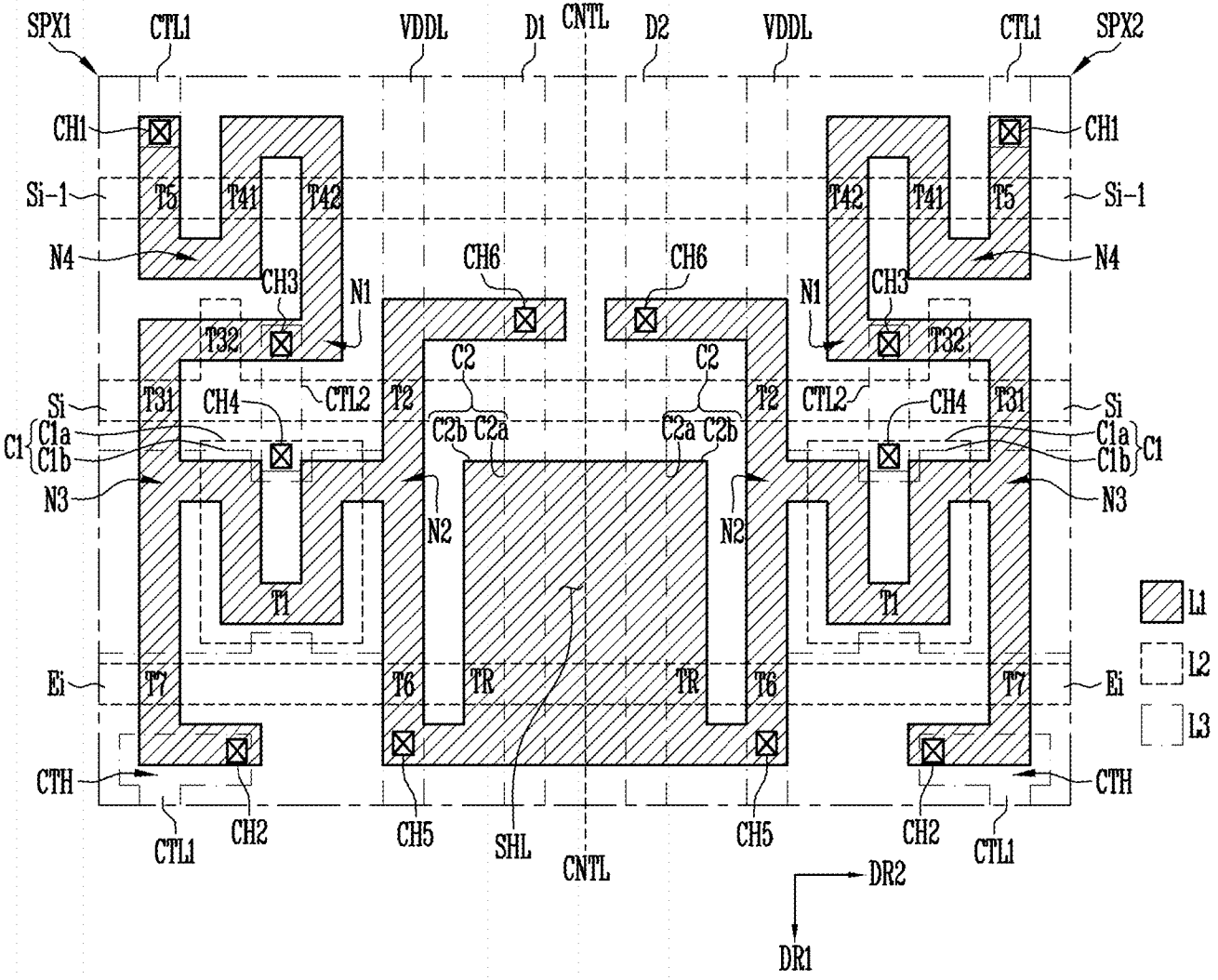
FIGS. 7 to 9 are diagrams illustrating structures of sub-pixels in accordance with an embodiment of the disclosure.

In an embodiment of the sub-pixel SPX, the second electrode C2*b* of the second capacitor C2 may be defined by a shielding layer SHL (shown in FIG. 7).

In one embodiment, for example, the second capacitor C2 may be a parasitic capacitor formed between the shielding layer SHL and the j-th data line Dj.

In an embodiment of the disclosure, the organic light-emitting diode OLED may generate light having various colors including red, green, and blue in response to current supplied from the driving transistor, but the disclosure is not limited thereto. For instance, the OLED may generate white light depending on the amount of current supplied from the drive transistor. In this case, a separate color filter or the like may be used to embody a color image.

Figure 6:
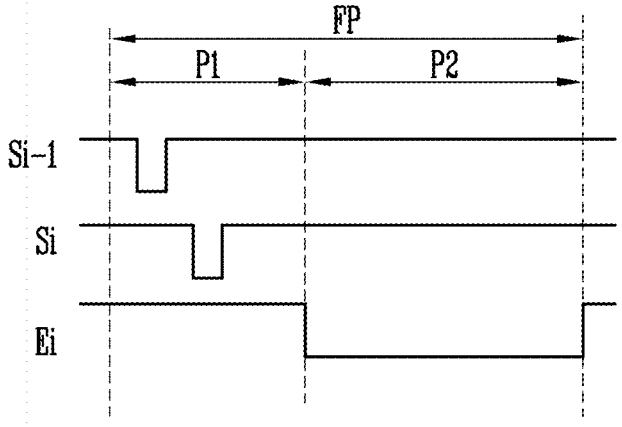
FIG. 6 is a diagram illustrating a method of driving the display device in accordance with an embodiment of the disclosure.

FIG. 6 is a diagram illustrating a method of driving the display device 100 (refer to FIG. 1) in accordance with an embodiment of the disclosure.

FIG. 6 shows a scan signal to be supplied to the (i−1)-th scan line Si−1, a scan signal to be supplied to the i-th scan line Si, and an emission control signal to be supplied to the i-th emission control line Ei, during one frame period FP.

Referring to FIGS. 1 to 6, the display device 100 may be driven with the frame period FP as a unit.

The frame period FP may include a first period P1 and a second period P2.

The first period P1 may be a non-emission period. The second period P2 may be an emission period.

During the first period P1, scan signals may be sequentially supplied to the (i−1)-th scan line Si−1 and the i-th scan line Si.

During the second period P2, an emission control signal may be supplied to the i-th emission control line Ei.

When a scan signal is applied to the (i−1)-th scan line Si−1, the fourth transistors T41 and T42 and the fifth transistor T5 may be turned on.

When the fourth transistors T41 and T42 are turned on, the first node N1 may be initialized to the voltage of the third power supply Vint. When the fifth transistor T5 is turned on, the anode electrode CTH may be initialized to the voltage of the third power supply Vint.

When a scan signal is supplied to the i-th scan line Si, the second transistor T2 and the third transistors T31 and T32 may be turned on.

When the second transistor T2 is turned on, the voltage of a data signal supplied to the j-th data line Dj may be applied to the second node N2.

The voltage of the data signal applied to the second node N2 may be applied to the third node N3 via the first transistor T1. Here, the threshold voltage of the first transistor T1 may be reflected in the voltage of the data signal. In one embodiment, for example, a voltage obtained by subtracting the threshold voltage of the first transistor T1 from the voltage of the data signal may be applied to the third node N3.

When the third transistors T31 and T32 are turned on, the voltage of the third node N3 may be applied to the first node N1 via the third transistors T31 and T32, and the first capacitor C1 may store the voltage of the third node N3.

When an emission control signal is supplied to the i-th emission control line Ei, the sixth transistor T6, the seventh transistor T7, and the reference transistor TR may be turned on.

When the sixth transistor T6 and the seventh transistor T7 are turned on, driving current may flow via the organic light-emitting diode OLED such that the organic light-emitting diode OLED may generate light corresponding to the driving current. Therefore, the sub-pixel SPX may emit light.

When the reference transistor TR is turned on, the first power supply ELVDD may be applied to the second electrode C2*b* of the second capacitor C2. In such an embodiment, the first power supply ELVDD may be supplied to the shielding layer SHL shown in FIG. 7.

Figure 8:
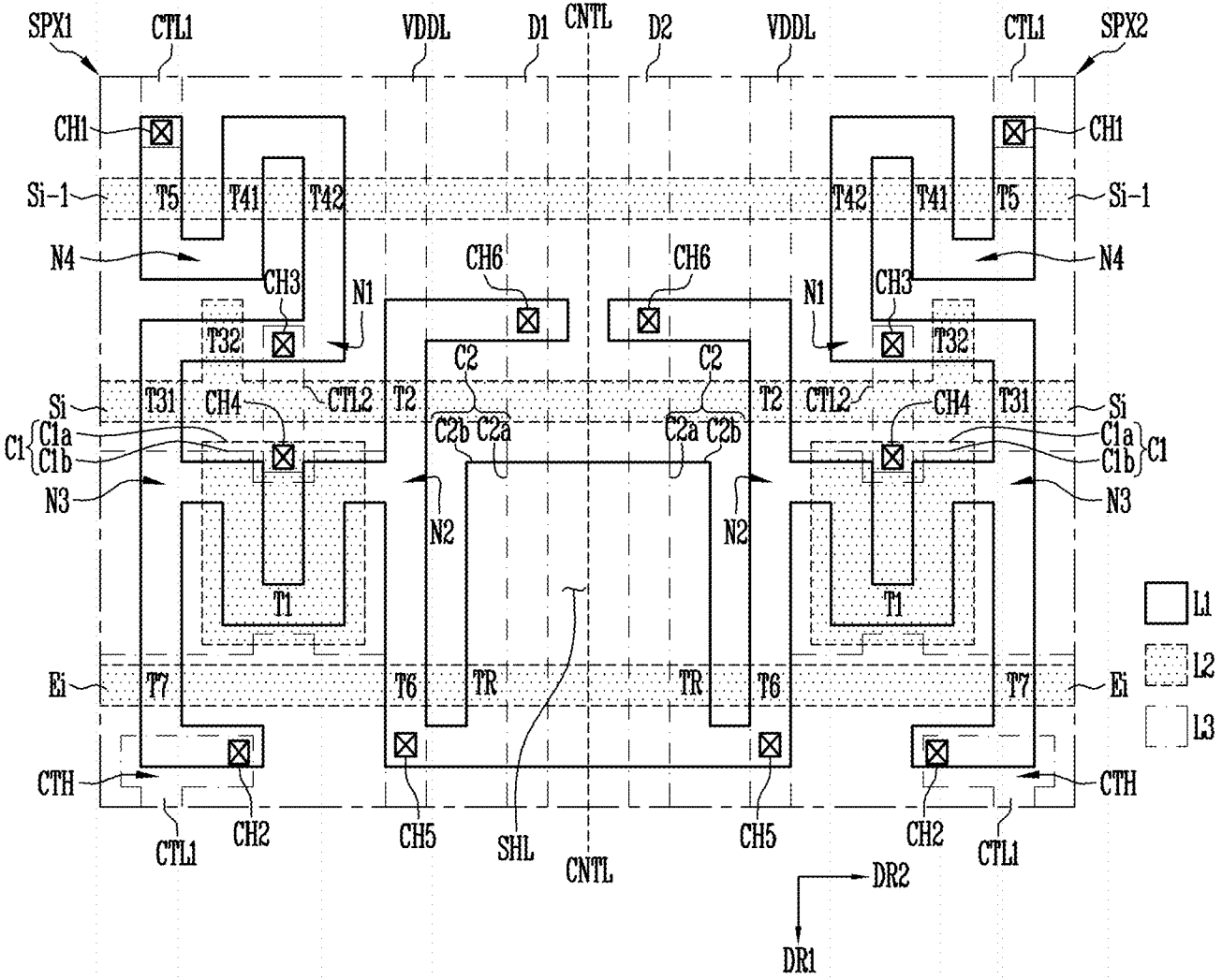
Figure 9:
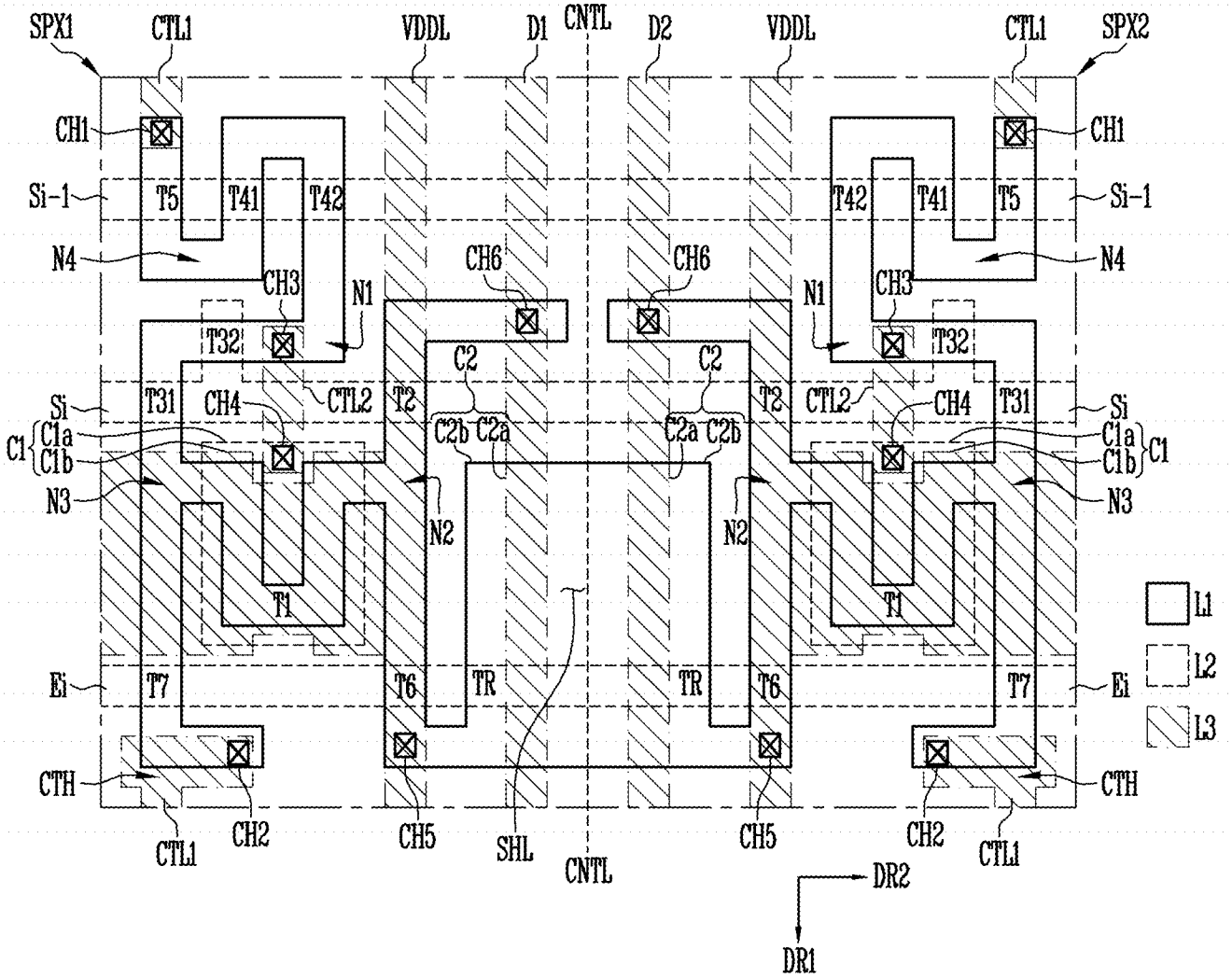

FIGS. 7 to 9 are diagrams illustrating the structures of the sub-pixels in accordance with an embodiment of the disclosure.

FIGS. 7 to 9 are plan views of the first and the second sub-pixels SPX1 and SPX2 showing the second capacitor C2, the reference transistor TR, and the flip pixel structure that show technical characteristics of the disclosure.

In FIGS. 7 to 9, a first layer L1 is shown by solid lines, a second layer L2 is shown by even-dashed lines, and a third layer L3 is shown by dot-dash lines.

In FIG. 7, the first layer L1 is emphasized. In FIG. 8, the second layer L2 is emphasized. In FIG. 9, the third layer L3 is emphasized.

In one embodiment, for example, the second layer L2 may be disposed over the first layer L1, and the third layer L3 may be disposed over the second layer L2.

In an embodiment, components on a same layer may include a same material as each other.

Although not shown, separate interlayer insulating layers may be disposed between the first layer L1, the second layer L2 and the third layer L3. The first layer L1, the second layer L2 and the third layer L3 may be electrically coupled to each other through contact holes defined in the interlayer insulating layers.

Referring to FIGS. 5 to 9, in an embodiment, the respective structures of the first and the second sub-pixel SPX1 and SPX2 may be line-symmetrical with each other based on a center line CNTL along a first direction DR1. In such an embodiment, the respective structures of the first and the second sub-pixels SPX1 and SPX2 may be line-symmetrical with each other based on the first data line D1 and the second data line D2 along the first direction DR1. Herein, the term "flip pixel structure" may mean a line-symmetric structure based on the first data line D1 and the second data line D2, as shown in FIGS. 7 to 9 illustrating the sub-pixels.

The structure of each of the first and the second sub-pixels SPX1 and SPX2 may include the first to the seventh transistors T1 to T7, the reference transistor TR, the first capacitor C1 and the second capacitor C2 as illustrated in FIG. 5.

For convenience of illustration and description, the structure of the organic light-emitting diode OLED shown in FIG. 5 will be omitted.

Hereinafter, the structure of the first sub-pixel SPX1 will be described in detail. In such an embodiment, the second sub-pixel SPX2 has a structure substantially the same as that of the first sub-pixel SPX1, and any repetitive detailed description thereof will be omitted.

Semiconductor layers of the first to the seventh transistors T1 to T7 and the reference transistor TR may be disposed on the first layer L1 and coupled to each other.

The gate electrode of the first transistor T1 may be defined or embodied by the first electrode C1*a* of the first capacitor C1 disposed on the second layer L2.

The gate electrodes of the second transistor T2 and the third transistors T31 and T32 may be defined or embodied by the i-th scan line Si disposed on the second layer L2.

The gate electrodes of the fourth transistors T41 and T42 and the fifth transistor T5 may be defined or embodied by the (i−1)-th scan line Si−1 disposed on the second layer L2.

The gate electrodes of the sixth transistor T6, the seventh transistor T7, and the reference transistor TR may be defined or embodied by the i-th emission control line Ei disposed on the second layer L2.

The semiconductor layer of the reference transistor TR may be disposed on the shielding layer SHL and overlap the first data line D1.

The first electrode C1*a* of the first capacitor C1 may be defined by the gate electrode of the first transistor T1 disposed in the second layer L2. In such an embodiment, the second electrode C1*b* of the first capacitor C1 may be disposed in the third layer L3 and be defined by a part extending from a driving voltage liner VDDL.

The first electrode C2*a* of the second capacitor C2 may be defined by the first data line D1 that overlaps the shielding layer SHL. The second electrode C2*b* of the second capacitor C2 may be defined by the shielding layer SHL.

In such an embodiment, the second capacitor C2 may be provided as a parasitic capacitor in the circuit of the sub-pixel SPX.

A first contact hole CH1 may electrically couple an electrode of the fifth transistor T5 disposed in the first layer L1 to a first connection line CTL1 disposed in the third layer L3.

A second contact hole CH2 may electrically couple an electrode of the seventh transistor T7 disposed in the first layer L1 to the first connection line CTL1 disposed in the third layer L3.

Although not shown, the first connection line CTL1 may be coupled to the anode electrode CTH of the organic light-emitting diode OLED.

A third contact hole CH3 may electrically couple an electrode of each of the third transistors T31 and T32 disposed in the first layer L1 to a second connection line CTL2 disposed in the third layer L3.

A fourth contact hole CH4 may electrically couple the first electrode C1*a* of the first capacitor C1 disposed in the second layer L2 to the second connection line CTL2 disposed in the third layer L3.

A fifth contact hole CH5 may electrically couple an electrode of the sixth transistor T6 disposed in the first layer L1 to the driving voltage line VDDL disposed in the third layer L3.

A sixth contact hole CH6 may electrically couple an electrode of the second transistor T2 disposed in the first layer L1 to the first data line D1 disposed in the third layer L3.

The invention should not be construed as being limited to the exemplary embodiments set forth herein. Rather, these exemplary embodiments are provided so that this disclosure will be thorough and complete and will fully convey the concept of the invention to those skilled in the art.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A display device comprising:

a first pixel comprising a first sub-pixel coupled to a first data line, and a second sub-pixel coupled to a second data line;

a data driver which supplies data signals to a first output line and a second output line in a time-sharing manner; and a switch unit which distributes the data signals to the first data line and the second data line based on a first control signal, wherein a structure of the first sub-pixel and a structure of the second sub-pixel are line-symmetrical with each other, based on the first data line and the second data line, which are disposed between the first sub-pixel and the second sub-pixel, and wherein each of the first sub-pixel and the second sub-pixel comprises:

an organic light-emitting diode;

a first transistor which controls a driving current flowing from a first power supply to a second power supply via the organic light-emitting diode, in response to a voltage supplied to a node connected thereto;

emission control transistors disposed on a path of the driving current, wherein the emission control transistors are turned on when an emission control signal is supplied thereto; and a reference transistor which couples a shielding layer overlapping a corresponding data line to the first power supply when the emission control signal is supplied thereto.

2. The display device according to claim 1, further comprising:

a second pixel comprising a third sub-pixel coupled to a third data line, and a fourth sub-pixel coupled to a fourth data line, wherein the switch unit distributes the data signals to the third data line and the fourth data line based on a second control signal.

3. The display device according to claim 2, further comprising:

a scan driver which supplies a scan signal to a scan line coupled to the first pixel and the second pixel.

4. The display device according to claim 3, wherein the data driver supplies a first data signal and a second data signal to the first output line and the second output line when the first control signal is supplied thereto, and the data driver supplies a third data signal and a fourth data signal to the first output line and the second output line when the second control signal is supplied thereto.

5. The display device according to claim 4, wherein the first to fourth data signals are applied to the first to the fourth sub-pixels, respectively, in response to the scan signal supplied thereto.

6. The display device according to claim 3, wherein a period, during which the first control signal is supplied, and a period, during which the second control signal is supplied, do not overlap a period, during which the scan signal is supplied.

7. The display device according to claim 2, wherein the switch unit comprises:

a first switch which couples the first output line to the first data line when the first control signal is supplied thereto;

a second switch which couples the second output line to the second data line when the first control signal is supplied thereto;

a third switch which couples the first output line to the third data line when the second control signal is supplied thereto; and a fourth switch which couples the second output line to the fourth data line when the second control signal is supplied thereto.

8. The display device according to claim 7, wherein at least one of the first switch, the second switch, the third switch and the fourth switch is a P-type metal-oxide-semiconductor transistor.

9. The display device according to claim 2, wherein a period, during which the first control signal is supplied, does not overlap a period, during which the second control signal is supplied.

10. The display device according to claim 2, further comprising:

a timing controller which supplies the first control signal and the second control signal to the switch unit.

11. The display device according to claim 1, wherein the first sub-pixel and the second sub-pixel emit light of different colors from each other.

12. The display device according to claim 11, wherein the first sub-pixel emits at least one of red light and blue light, and the second sub-pixel emits green light.

13. A display device comprising:

a first pixel including first and second sub-pixels coupled to first and second data lines, respectively;

a scan driver which supplies a scan signal to a scan line coupled to the first and the second sub-pixels;

an emission control driver which supplies an emission control signal to an emission control line coupled to the first and the second sub-pixels;

a data driver which supplies data signals to a first output line and a second output line in a time-sharing manner; and a switch unit which distributes the data signals to the first and the second data lines based on a first control signal, wherein each of the first and the second sub-pixels comprises:

a first transistor which controls a driving current flowing from a first power supply to a second power supply in response to a voltage supplied to a node connected thereto;

a shielding layer overlapping the first and the second data lines; and a reference transistor which couples the shielding layer to the first power supply when the emission control signal is supplied thereto.

14. The display device according to claim 13, further comprising:

a second pixel comprising third and fourth sub-pixels coupled to third and fourth data lines, respectively, wherein the switch unit distributes the data signals to the third data line and the fourth data line based on a second control signal.

15. The display device according to claim 14, wherein the switch unit comprises:

a first switch which couples the first output line to the first data line when the first control signal is supplied thereto;

a second switch which couples the second output line to the second data line when the first control signal is supplied thereto;

a third switch which couples the first output line to the third data line when the second control signal is supplied thereto; and a fourth switch which couples the second output line to the fourth data line when the second control signal is supplied thereto.

16. The display device according to claim 14, wherein a period, during which the first control signal is supplied, does not overlap a period, during which the second control signal is supplied.

17. The display device according to claim 13, wherein the first sub-pixel and the second sub-pixel emit light of different colors from each other.

18. The display device according to claim 17, wherein the first sub-pixel emits at least one of red light and blue light, and the second sub-pixel emits green light.

19. The display device according to claim 13, wherein a structure of the first sub-pixel and a structure of the second sub-pixel are line-symmetrical with each other based on the first data line and the second data line, which are disposed between the first sub-pixel and the second sub-pixel.

* * * * *